United States Patent [19]

Suggi-Liverani et al.

[11] Patent Number: 4,699,273

[45] Date of Patent: Oct. 13, 1987

[54] SORTING MACHINE

[75] Inventors: Furio Suggi-Liverani, Trieste, Italy; William S. Maughan, West Sussex; Ronald C. Wainwright, Hertfordshire, both of England

[73] Assignees: Gunson's Sortex Limited, London, England; Illycaffe S.p.A., Trieste, Italy

[21] Appl. No.: 676,889

[22] Filed: Nov. 30, 1984

[30] Foreign Application Priority Data

Dec. 6, 1983 [GB] United Kingdom ..... 8332495

[51] Int. Cl.[4] ..... B07C 5/342

[52] U.S. Cl. ..... 209/580; 209/586; 209/587; 250/226; 356/425

[58] Field of Search ..... 209/555, 556, 558, 576, 209/580–582, 586, 587, 588, 639, 644; 250/226; 356/407, 420, 425

[56] References Cited

U.S. PATENT DOCUMENTS

| | | | |
|---|---|---|---|
| 2,645,343 | 7/1953 | Nemir | 209/581 |
| 3,910,701 | 10/1975 | Henderson et al. | 250/226 X |
| 4,132,314 | 1/1979 | von Beckmann et al. | 209/586 X |
| 4,203,522 | 5/1980 | Fraenkel et al. | 209/581 X |
| 4,350,442 | 9/1982 | Arild et al. | 209/582 X |
| 4,513,868 | 4/1985 | Culling et al. | 209/576 X |
| 4,624,368 | 11/1986 | Satake | 209/581 |
| 4,625,871 | 12/1986 | Satake | 209/581 X |

FOREIGN PATENT DOCUMENTS

| | | | |
|---|---|---|---|
| 0044014 | 1/1982 | European Pat. Off. | 209/581 |
| 0109686 | 5/1984 | European Pat. Off. | 209/580 |
| 0111877 | 6/1984 | European Pat. Off. | 209/580 |
| 881161 | 11/1961 | United Kingdom . | |
| 885283 | 12/1961 | United Kingdom . | |
| 885285 | 12/1961 | United Kingdom . | |
| 1373975 | 11/1974 | United Kingdom . | |
| 1460527 | 1/1977 | United Kingdom . | |
| 2025038 | 1/1980 | United Kingdom | 209/582 |
| 1604745 | 12/1981 | United Kingdom . | |
| 2098729 | 11/1982 | United Kingdom . | |
| 2136957 | 9/1984 | United Kingdom | 209/580 |

*Primary Examiner*—Randolph A. Reese
*Assistant Examiner*—Edward M. Wacyra
*Attorney, Agent, or Firm*—Cushman, Darby & Cushman

[57] ABSTRACT

A sorting machine is disclosed for sorting objects by examining light from the objects in at least two different parts of the spectrum. The objects to be sorted are fed to a viewing zone where they are illuminated in at least two different parts of the spectrum. The objects passing through the viewing zone are viewed against at least one background which is illuminated by at least first and second lighting units which are separate from the lighting employed to illuminate the viewing zone, the first and second lighting units being respectively arranged to cause the respective background to emit light in the at least two different parts of the spectrum. A discriminator is employed for determining whether objects which have been so viewed are desired, and there is an object separator controlled by the discriminator, for effecting relative separation between desired and undesired objects.

17 Claims, 7 Drawing Figures

SORTING MACHINE

Figure 1:
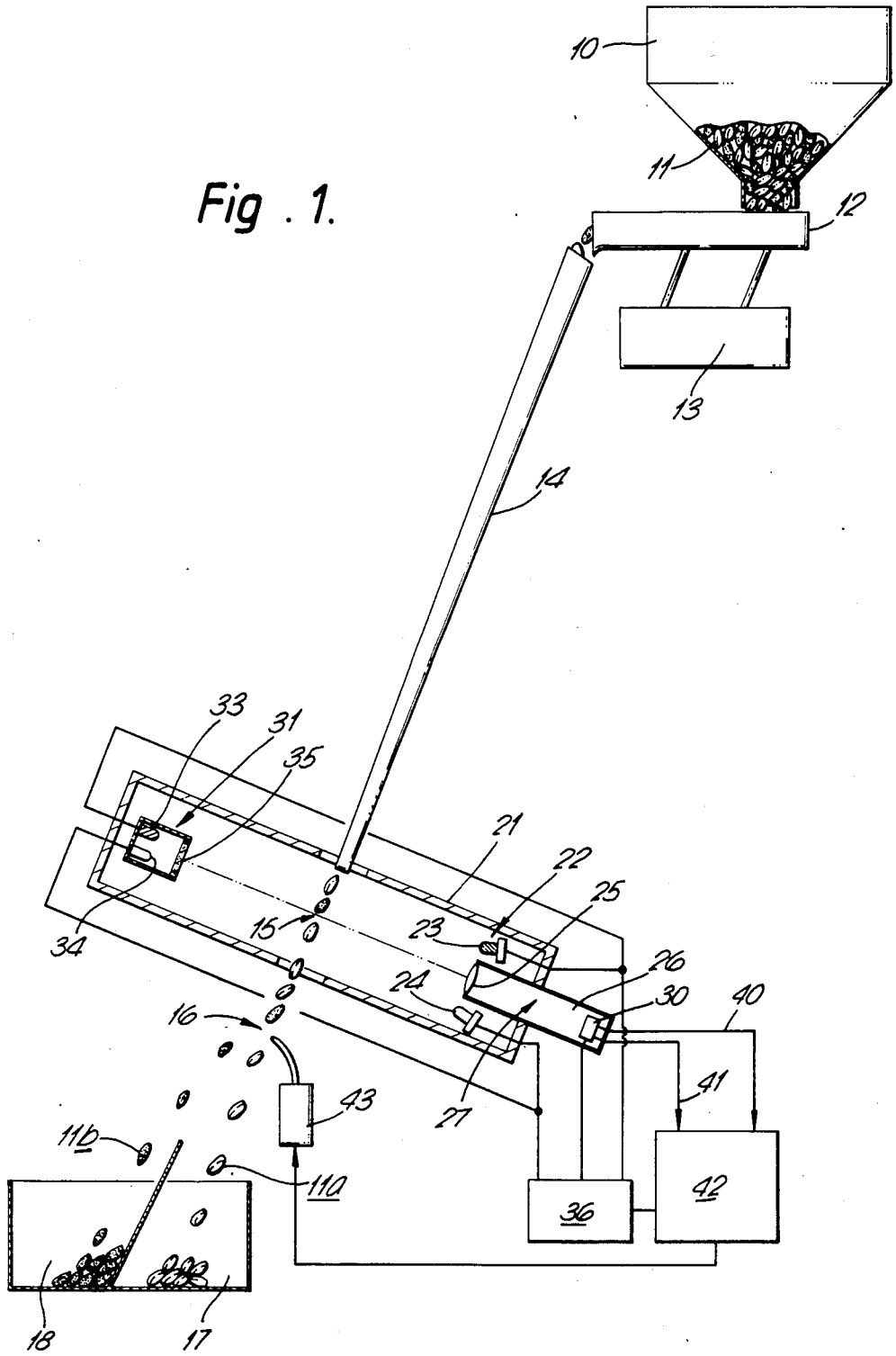

This invention concerns a sorting machine for sorting objects by examining light reflected or transmitted by the objects in at least two different parts of the spectrum. Thus, although the invention is not so restricted, it more particularly concerns a bichromatic sorting machine which observes the light reflected from the surface of objects in order to separate those objects which have a desired colour or reflectivity from those which do not.

Such machines are commonly used in the processing of agricultural produce, such as rice, coffee and beans, and also in the purification of minerals, either in the form of streams of fine particles or in the form of lumps of ore.

Such machines usually view the objects to be sorted against a background and look for differences between the background and the reflectivities of such objects.

In the matched background approach to sorting, the reflectivity of the background is chosen so that it matches the average reflectivity of the objects. This technique is particularly effective in minimising the effect on the quality of the sort which arises from variation in the size of the objects, since all objects which are lighter than the background will result in an increase in the optical signal produced, whilst all objects which are darker than the background will result in a decrease, irrespective of their size.

The balancing of backgrounds is relatively simple in the case of monochromatic machines which make a measurement in a single wavelength band. Coarse adjustment can be carried out by the selection of one of the limited range of neutral (grey) backgrounds and final adjustment can be made by altering the position of the background relative to the lighting sources. Unfortunately, the balancing of the backgrounds in bichromatic machines, where two measurements are made in two different wavelength bands or colour channels, is considerably more complex. The background must be balanced to the average reflectivity of the objects in both colour channels. Therefore, it is necessary to adjust the background for both colour and brightness. In practice, this requires the selection of a background from a large number of differently coloured backgrounds as well as the mechanical adjustment of the position of the background. Because of the finite number of backgrounds available, this usually means that the machine is set to a compromise position, with both colour channels nearly but not exactly balanced.

According to the present invention there is provided a sorting machine for sorting objects by examining light reflected or transmitted by the objects in at least two different parts of the spectrum, said sorting machine comprising feeding means for feeding objects to be sorted to a viewing zone; illuminating means for effecting illumination in at least two different parts of the spectrum of objects passing through the viewing zone; viewing means arranged to view objects passing through the viewing zone; at least one background means against which the objects are viewed by the viewing means; at least first and second lighting means for each background means, the said first and second lighting means being separate from the said illuminating means and being respectively arranged in operation to cause the respective background means to emit light in said at least two different parts of the spectrum; discriminator means, controlled by the output from the viewing means, for determining whether objects which have been so viewed are desired or undesired; and object separation means, controlled by said discriminator means, for effecting relative separation between desired and undesired objects.

Each of the first and second lighting means may comprise at least one incandescent lamp provided with an optical filter.

Preferably, however, the first and second lighting means comprise differently coloured first and second light-emitting diodes.

The use of differently coloured light emitting diodes enables one to overcome the background balancing problem referred to above by selecting differently coloured light-emitting diodes the colour of each of which is respectively appropriate to the average colour of the objects being sorted.

Means are preferably provided for varying the relative intensity of the light produced by the first and second lighting means.

The or each background means preferably comprises a housing having a diffusing screen behind which are disposed the said first and second lighting means.

The illuminating means preferably comprises a plurality of differently coloured light-emitting diodes which are respectively arranged to direct differently coloured light onto objects passing through the viewing zone so that light is reflected by or transmitted through the objects.

Preferably there are control means which are arranged to control the light produced by each light-emitting diode of the illuminating means.

The use of light-emitting diodes, instead of the generally used incandescent lamps, in a bichromatic sorting machine gives rise to a number of other important advantages.

In the first place, all the output power of a light-emitting diode is concentrated in a narrow wavelength band and is emitted throughout a restricted angular range. Thus light-emitting diodes can be selected whose colour is appropriate having regard to the average colour of the objects being sorted, and the light from these diodes can be focussed on the objects passing through the viewing zone. This results in a considerable saving of power and reduction of heat in comparison with the use of the conventional incandescent lamps which emit light in a wide wavelength band and over a wide angular range. Moreover, in view of the narrow wavelength band of the light from light-emitting diodes, the latter may be employed without necessarily using optical filters, whereas such filters are essential when conventional incandescent lamps are employed.

Light-emitting diodes also have the unique advantage of being capable of being modulated at a very high rate. The present invention employs this property of light-emitting diodes so as to produce a number of advantages. Thus, for example, the modulation may be such as to enable the sorting machine to distinguish between the illumination provided by the light-emitting diodes and any stray illumination.

Furthermore, if the light-emitting diodes of the illuminating means are modulated by being switched OFF and ON while a background means is left illuminated, a size signal can be produced by the extent to which the object being viewed obscures the background means when the light-emitting diodes of the illuminating means are OFF.

Moreover, if the differently coloured light emitting diodes of the illuminating means are modulated by being alternately switched on and off, it is possible to effect sorting from any particular direction without the use of filters of any kind and with the use of a single photo-electric detector.

The control means may be arranged to effect ON and OFF operation of the light-emitting diodes of the illuminating means. Thus the lighting means for lighting the background means may be arranged to be operative throughout the said ON and OFF operation, whereby during the said OFF operation the or each output from the discriminator means is representative of the degree to which the light from the background means is obscured by an object in the viewing zone and is thus representative of the size of the object.

Alternatively, the control means may be arranged to effect amplitude modulation of the light produced by the light-emitting diodes of the illuminating means.

The control means may be arranged to adjust the relative intensity of the differently coloured light.

The control means may alternatively effect differential modulation of the light produced by differently coloured first and second light-emitting diodes of the illuminating means. In operation, each of the first and second light-emitting diode means of the illuminating means may be switched ON at a time when the other light-emitting diode means is switched OFF, whereby the output from the discriminator means is successively respectively representative of the light produced by the first and second light-emitting diodes of the illuminating means.

Alternatively, each of the first and second light-emitting diodes of the illuminating means may be amplitude modulated at a different frequency, the viewing means comprising first and second bandpass filters whose outputs are respectively representative of the light from the objects produced respectively by the first and second light-emitting diodes of the illuminating means.

The same or similar differently coloured first and second light-emitting diodes may be used to effect both front lighting of the objects and lighting of the background means.

The invention also comprises a method of sorting by examining light reflected or transmitted by the objects in at least two different parts of the spectrum, said method comprising feeding objects to be sorted to a viewing zone, employing illuminating means to effect illumination in two different parts of the spectrum of objects passing through the viewing zone; viewing objects passing through the viewing zone against at least one background means; employing first and second lighting means for each background means, the said first and second lighting means being separate from the said illuminating means and being respectively arranged to cause the respective background means to emit light in said two different parts of the spectrum; employing discriminator means, controlled by the output from the viewing means, for determining whether objects which have been so viewed are desired or undesired; and employing object separation means, controlled by said disciminator means, for effecting relative separation between desired and undesired objects.

Preferably, prior to feeding the objects to the viewing zone, the colours of the first and second lighting means and the relative intensity of the light produced thereby were selected to suit the average colour of the objects.

Figure 2:
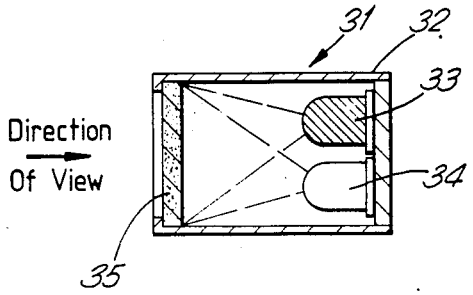
Figure 3:
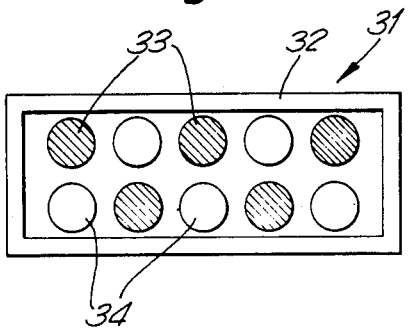
Figure 4:
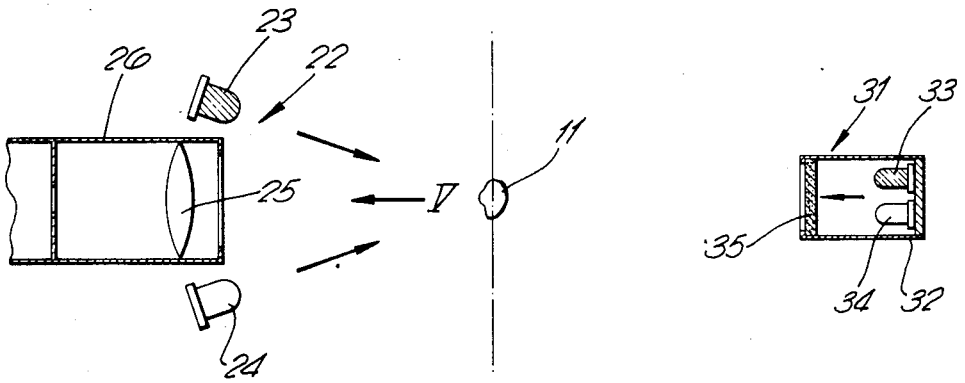
Figure 5:
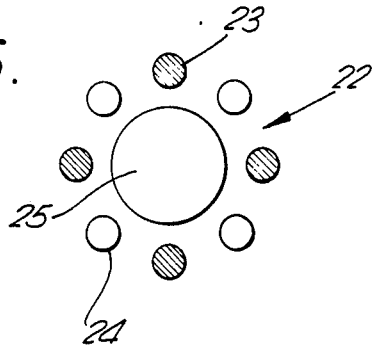
Figure 6:
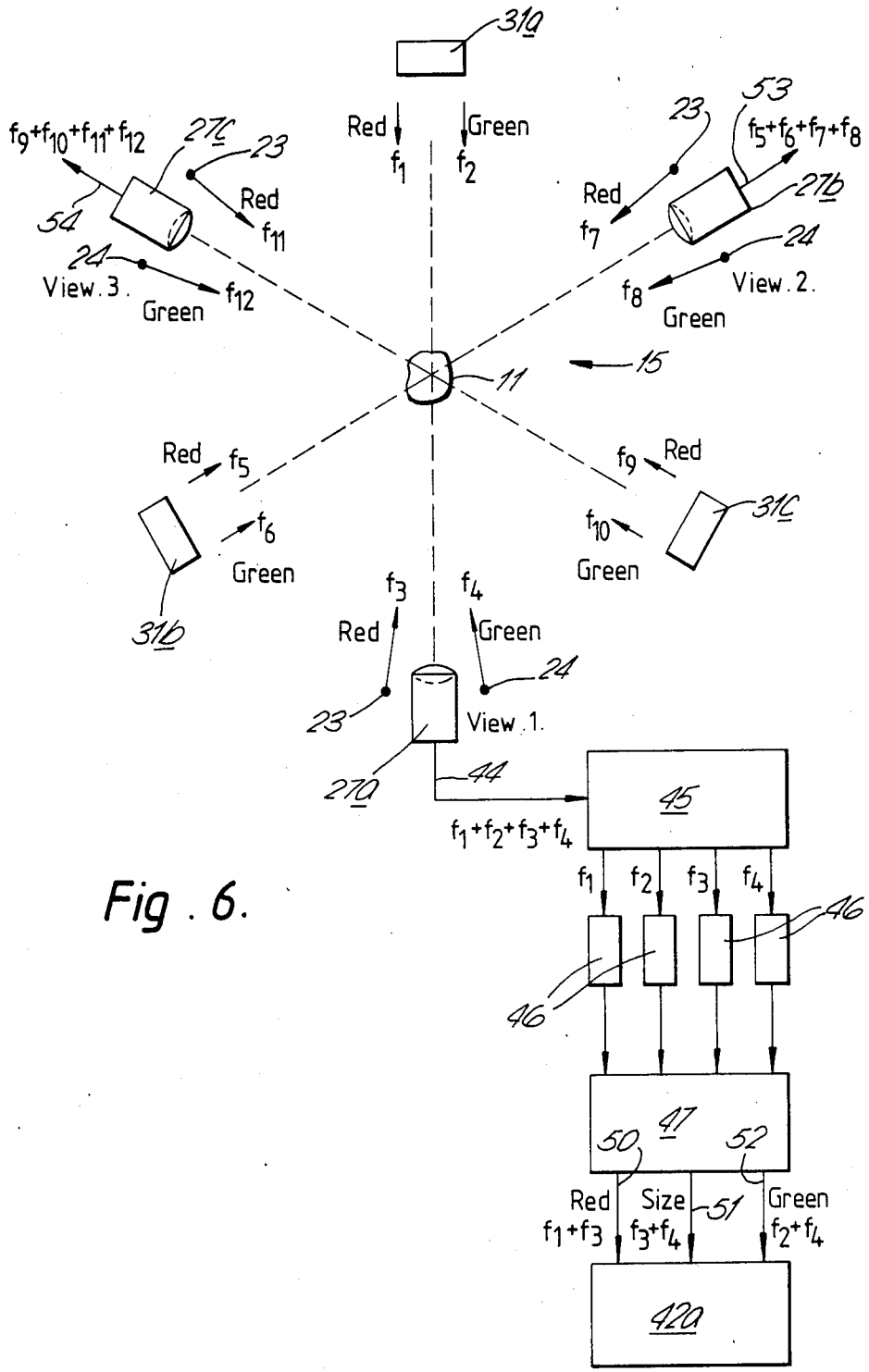
Figure 7:
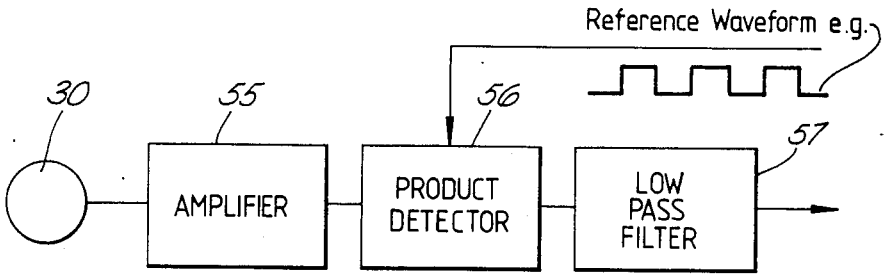

The invention is illlustrated, merely by way of example, in the accompanying drawings, in which:

FIG. 1 is a diagrammatic view of a first embodiment of a sorting machine according to the present invention, FIGS. 2 and 3 are respectively a side view and an elevation of a background unit forming part of the sorting machine of FIG. 1, FIG. 4 illustrates on a larger scale a portion of the structure shown in FIG. 1, FIG. 5 is a diagrammatic view looking in the direction of the arrow $\underline{V}$ of FIG. 4;

FIG. 6 is a diagrammatic view of a second embodiment of a sorting machine according to the present invention, and FIG. 7 is a circuit diagram showing a feature of a sorting machine according to the present invention.

Referring first to FIG. 1, a sorting machine according to the present invention comprises a hopper 10 adapted to contain objects 11 to be sorted. Such objects may, for example, be agricultural products such as peas, beans (e.g. coffee beans), nuts, diced potatoes and rice, or mineral products, such as diamonds and other precious stones and pieces of ore. The term "objects" is, moreover, used herein in a wide of sense so as, for example, to include particulate material.

The objects 11 in the hopper 10 may pass to a tray 12 which is, in operation, vibrated by a vibrator 13 so as to cause the objects 11 to pass, one at a time, to a chute or duct 14 which is disposed at an angle within the range of 10° to 20° (e.g. 15°) to the vertical. The chute or duct 14 may be formed of a material having a low coefficient of friction such as anodised aluminium.

The objects 11, which slide under gravity down the chute 14, travel successively in free fall past a viewing zone 15 and then an object separation zone 16 which is disposed beneath the viewing zone 15. In the object separation zone 16 relative separation is effected between desired objects 11*a* and undesirable objects 11*b*, e.g. between those whose colours are in a predetermined relative relationship as regards their intensity and those whose colours are not in this relationship. The desired objects 11*a* pass to an "accept" area 17, while the undesired objects 11*b l pass to a "reject" area 18.*

The viewing zone 15 is provided within an optical box 21 which, if desired, may have a light-reflective internal surface, although this is not essential. Mounted within the optical box 21 are illuminating means 22 (best seen in FIGS. 4 and 5) which effect front illumination of objects 11 passing through the viewing zone 15.

The sorting machine shown in FIG. 1 is a bichromatic sorting machine in which the objects 11 are examined for their reflectivities in two different parts of the spectrum. Thus sorting could, for example, be effected so as to remove any objects 11 which did not have a predetermined reflectivity in one or both of these parts of the spectrum or which did not have a predetermined relationship between the intensities in the light reflected from the objects in the said parts of the spectrum. For convenience these parts of the spectrum are hereinafter referred to as "red" and "green" , but it should be understood that sorting could also be effected in other colours. Moreover, although the invention is described herein with reference to the reflection of light by the objects, it should be clearly understood that the invention is also applicable to sorting by reference to the transmission of light by the objects.

The illuminating means 22 comprise one or more "red" light-emitting diodes 23 and one or more "green" light-emitting didoes 24. As shown in FIG. 5, an annular array of the diodes 23, 24 may be arranged concentrically of a lens 25, the diodes 23, 24 being arranged alternately in said array and being equi-angularly spaced apart from each other.

Light emitting diodes produce light in a narrow spectral band, and the diodes 23, 24 are carefully selected so as respectively to be appropriate to the colour components of the average colour of the objects 11 being sorted. That is to say, the colours of the light-emitting diodes 23, 24 are carefully selected to match the wavelengths at which reflectivity measurements are to be made.

Moreover, light-emitting didoes emit light throughout a limited angular range only. The light-emitting diodes 23, 24 may thus be "focussed" on the viewing zone 15 so that illumination of an object 11 passing through the viewing zone 15 may be achieved with a reduction in the electrical power consumed and the heat produced by comparison with that associated with wide spectral range, non-directional, incandescent lamps.

The lens 25 is provided adjacent the front of a lens tube 26 which forms part of a viewing means 27 arranged to view objects 11 passing through the viewing zone 15. The viewing means 27 also comprise photoelectric detector means 30 onto which the lens 25 directs images of the objects 11 passing through the viewing zone 15. The objects 11 are viewed against a background unit 31 (best seen in FIGS. 2 and 3).

The background unit 31 comprises a box or housing 32 in which are mounted a plurality of "red" light-emitting diodes 33 and a plurality of "green" light-emitting diodes 34. Thus the diodes 33, 34 may, if desired, be alternately arranged, as shown in FIG. 3, in two horizontal rows, although other arrangements are obviously possible. The front of the housing 32 is provided with a diffusing screen 35 behind which the light-emitting diodes 33, 34 are disposed so as to constitute a means for lighting up the diffusing screen 35 in either "red" or "green" according to which of the diodes 33, 34 are switched ON.

The operation of the diodes 23, 24 and 33, 34 is controlled by a control means 36 which may be arranged to control the relative drive current to the "red" and "green" light emitting diodes respectively or may be arranged to effect modulation of the illumination produced by these diodes. Thus, as explained in greater detail below, the control means 36 may effect ON/OFF operation of these diodes or may effect amplitude modulation thereof.

The detector means 30, which may be constituted by one or more photo-electric detectors, produces a "red" output 40 and a "green" output 41 each of which is representative of the respective "red" or "green" modulated illumination received by the detector means 30 from the objects 11 passing through the viewing zone 15. As described in greater detail below, the detector means 30 may be such as to be non-responsive to any illumination other than the modulated illumination derived from the light-emitting diodes 23, 24, 33, 34. The "red" output 40 and the "green" output 41 are transmitted to a discriminator 42 which may, for example, be constituted by a micro-computer. The discriminator 42 is pre-programmed so as to determine, under the control of the outputs 40, 41, whether the objects 11 which have been viewed by the viewing means 27 are desired objects 11*a* or undesired objects 11*b*. Thus each of these outputs 40, 41 may be compared in the discriminator 42 with a predetermined datum.

The discriminator 42 controls the operation of a normally closed valve (not shown) in a pneumatic ejector 43 so that, when an undesired object 11*b* is detected in the viewing zone 15, the said valve is opened after a suitable delay. A puff of air is thus directed onto the undesired object 11*b*, which has by this time travelled to the object separation zone 16, so as to deflect the object 11*b* into the "reject" area 18, the desired objects 11*a* being undeflected and passing to the "accept" area 17.

Since the "red" light-emitting diodes 33 are separate from the "green" light-emitting diodes 34, and sice light-emitting diodes are available in a large number of different shades of "red" and "green" and produce light in a narrow wavelength band, it is relatively easy to choose "red" light-emitting diodes 33 and "green" light-emitting diodes 34 which are appropriate to the average colour of the objects 11. Moreover, the control means 36, or some other means (not shown), may be operable to vary the current supply to the "red" light-emitting diodes 33 independently of the current supply to the "green" light-emitting diodes 34, or vice versa, so that the intensity of the "red" light produced by the diffusing screen 35 may be varied with respect to that of the "green" light thereof, or vice versa. A similar effect may also be produced by varying the relative numbers of "red" and "green" light-emitting diodes 33, 34, whereby the outputs 40 ,41 may be made approximately equal. Thus it is relatively easy to match the background unit 31 both to the average "redness" and "greeness" of the objects 11 and to the average relative "red/green" intensity of the objects 11.

In contrast, a background has previously been constituted by a background plate having a "red/green" colour which merely approximated to that of the average of the objects 11. Since it was practicable to provide only a limited stock of "red/green" plates from which to select a suitable plate, it was impossible in practice to obtain a "red/green" plate from this stock which was perfectly matched to the objects 11. Moreover, deciding which plate of the stock had the closest approximation to the average "red/green" colour of the objects, was a difficult and laborious procedure.

The control means 36 may be arranged to switch the light-emitting diodes 23, 24 and the detector means 30 ON/OFF synchronously at a high rate while leaving the light-emitting diodes 33, 34 illuminated throughout such ON/OFF operation of the light-emitting diodes 23, 24, there being a further detector (not shown) which is turned OFF/ON by the control means 36 synchronously with the ON/OFF operation of the detector means 30. While both the light-emitting diodes 23, 24 and the detector means 30 are turned ON, and the said further detector is turned OFF, conditions are momentarily identical to those which would prevail in an ordinary colour sorting machine. However, while both the light-emitting diodes 23, 24 and the detector means 30 are turned OFF and the said further detector is turned ON, the said further detector would measure the light originating from the background unit 31 only. The background unit 31, however, is partially obscured by the objects 11 passing through the viewing zone 15. Consequently,the output of the said further detector is dependent upon the size of any object 11 in the viewing zone 15 and thus a size signal may be transmitted from the said further detector to the discriminator 42 so as to improve the quality of sorting produced by the latter.

In the case of the arrangement described in the preceding paragraph, the light-emitting diodes 23, 24, when ON, are illuminated simultaneously, while the light-emitting diodes 33, 34, which will effect some rear lighting of objects 11 passing through the viewing zone 15, are illuminated simultaneously at all times. It is therefore necessary to provide either a detector means 30 comprising two detectors responsive respectively only to "red" and "green" light, or to provide two detectors each of which has a "red" or a "green" optical filter (not shown) in front of it so as to filter out the undesired light.

Alternatively, the control means (36) may be arranged to switch all the "red" light-emitting diodes 23, 33 ON/OFF simultaneously at a predetermined frequency and to switch all the "green" light-emitting diodes 24, 34, OFF/ON at the same frequency but out of phase so that the "red" and "green" illumination of the objects 11 passing through the sorting zone 15 occurs at different times. In this case, optical filters would not be required and the detector means 30 could be constituted by a single detector.

Yet a further possibility is that the control means 36 is arranged to effect simultaneous amplitude modulation e.g. sine wave modulation, of all the light-emitting diodes 23, 24, 33, 34. In this case, the discriminator means 42 may be arranged to distinguish between modulated light originating from the light-emitting diodes 23, 24, 33, 34 and stray light by ignoring the DC light signal from the detector means 30 and using only the AC modulated sine wave.

Alternatively, the control means 36 may be arranged to impart one frequency of amplitude modulation to the "red" light-emitting diodes 23, 33 and a different frequency of amplitude modulation to the "green" light-emitting diodes 24, 34, the detector means 30 being provided with respective "red" and "green" bandpass filters (not shown) so that the outputs 40, 41 are respectively representative of the "red" and "green" light only. Yet again, the "red" and "green" light-emitting diodes could be amplitude modulated at the same frequency but out of phase, the detector means 30 being provided with phase-responsive means (not shown) to separate the "red" and "green" signals.

For example, as shown in FIG. 7, the detector means 30 may be connected by way of an amplifier 55 to a product detector 56. The product detector 56 is supplied with a reference waveform, e.g. a square waveform, the product detector 56 being such that only a signal of the same frequency as the reference waveform will be transformed by the product detector 56 to D.C. and so be accepted by a low pass filter 57 which is connected to receive the output of the product detector 56. All other signals, after passing the product detector 56, would still be in A.C. form and so be rejected by the low pass filter 57. Thus the circuit shown in FIG. 7 may be used to select any one desired frequency of modulation.

In the case of the system described above which employs ON/OFF switching, it is necessary to reject the input signal for half a cycle of the reference waveform. If the product detector 56 is replaced by a sample and hold circuit, not shown, driven by the reference waveform, the incoming signal will be sampled during the ON period and this value is then held by the sample and hold circuit during the OFF period.

As so far described,reference has been made to a sorting machine in which viewing of the objects occurs in one direction only. However, it should be clearly understood that the objects may,if desired, be viewed in two or more directions, e.g. in three equi-angularly spaced directions, as shown in the second embodiment of the present invention which is illustrated in FIG. 6. The said second embodiment will not be described in detail since it is generally similar to the first embodiment shown in FIGS. 1–5, similar reference numerals indicating similar parts.

As shown in FIG. 6,an object 11 in the viewing zone 15 of a bichromatic sorting machine is viewed by three viewing means **27*a*, 27*b*, 27*c* which view the object 11 along optical axes which are spaced apart from each other by 120°. Each of the viewing means 27*a*, 27*b*, 27*c* is provided with "red" and "green" light-emitting diodes 23, 24 which may be arranged as shown in FIGS. 4 and 5. Each viewing means 27*a*, 27*b*, 27*c* views the object 11 against a respective background unit 31*a*, 31*b*, 31*c* each of which may be formed as shown in FIGS. 2 and 3**.

Considering the viewing effected by the viewing means **27*a*, the latter will produce a composite signal 44 whose components comprise a "red" signal $f_1$ and a "green" signal $f_2$, derived from the light from the background unit 31*a*, and a "red" signal $f_3$ and a "green" signal $f_4$ derived from the light from the respective light-emitting diodes 23, 24. This composite signal 44 passes to a frequency selective circuit 45 which breaks down the composite signal 44 into its components $f_1$, $f_2$, $f_3$, $f_4$ and these components, after passing through respective demodulators 46, pass to an arithmetic unit 47. The latter produces three signals namely a "red" signal 50, which is constituted by the addition of the "red" signals $f_1$ and $f_3$, a size signal 51, which is constituted by the addition of the "red" signal $f_3$ and the "green" signal $f_4$, and a "green" signal 52**, which is constituted by the addition of the "green" signals $f_2$ and $f_4$.

Although this is not shown in FIG. 6,each of the viewing directions is similarly provided with a frequency selective circuit 45, demodulators 46, and an arithmetic unit 47. Thus the viewing means **27*b* will produce a composite signal 53 whose components comprise a "red" signal $f_5$ and a "green" signal $f_6$, derived from the light from the background unit 31*b*, and a "red" signal $f_7$ and a "green signal $f_8$ derived from the light from the respective light-emitting diodes 23, 24. Similarly, the viewing means 27*c* will produce a composite signal 54 whose components comprise a "red" signal $f_9$ and a "green" signal $f_{10}$, derived from the light from the background unit 31*c*** and a "red" signal $f_{11}$, and a "green" signal $f_{12}$ derived from the light from the respective light-emitting diodes.

The signals 50, 51, 52 from each of the three viewing directions pass to a micro-processor or other discriminator 42a which corresponds to the discriminator 42 of FIG. 1 and which controls the operation of the ejector 43.

The "red" and "green" light-emitting diodes employed in each of the background units **31*a*, 31*b*, 31*c* produce light of a slightly different frequency from those of the other background units. Similarly, the "red" and "green" light-emitting diode employed adjacent each of the viewing means 27*a*, 27*b*, 27*c* will produce light modulated at a slightly different frequency both from those of the other viewing means and from those of the respective background unit. This enables the arithmetic unit to add the signals $f_3$ and $f_4$ (or the signals $f_7$ and $f_8$, or the signals $f_{11}$ and $f_{12}$) so as to obtain a signal 51 which depends only on the size of the object. It also enables each of the viewing means 27***a*, 27*b*, 27*c* to be responsive only to the respective light of its own viewing direction, whereby the normally encountered problem of viewing specular reflection at glancing angles of incidence, which is derived from light used in the other viewing directions, is avoided.

Although the above description refers to each of three viewing directions as employing light at four different frequencies (e.g. $f_1$, $f_2$, $f_3$, $f_4$), it is possible to simplify the system using only three frequencies, e.g. the "red" signals $f_1$, $f_3$ could be used to determine size, and only one "green" signal need be used instead of the two "green" signals $f_2$, $f_4$.

We claim:

1. A sorting machine for sorting objects by examining light from the objects in at least two different parts of the spectrum, said sorting machine comprising:

feeding means for feeding objects to be sorted to a viewing zone;

illuminating means for effecting illumination in at least two different parts of the spectrum of objects passing through the viewing zone;

viewing means arranged to view objects passing through the viewing zone;

at least one background means against which the objects are viewed by the viewing means, at least first and second lighting means for each background means, said first and second lighting means being separate from the said illuminating means and being respectively adapted to emit light in different parts of the spectrum;

means for causing simultaneous operation of the first and second lighting means;

discriminator means, controlled by the output from the viewing means, for determining whether objects which had been so viewed are desired; and object separation means, controlled by said discriminator means, for effecting relative separation between desired and undesired objects.

2. A sorting machine as claimed in claim 1 in which each of the first and second lighting means comprises at least one incandescent lamp provided with an optional filter.

3. A sorting machine as claimed in claim 1 in which the first and second lighting means comprise differently coloured first and second light-emitting diodes.

4. A sorting machine as claimed in claim 3 in which the illuminating means comprise a plurality of differently coloured light-emitting diodes which are respectively arranged to direct differently coloured light onto objects passing through the viewing zone.

5. A sorting machine as claimed in claim 4 comprising control means arranged to control the light produced by each light-emitting diode of the illuminating means.

6. A sorting machine as claimed in claim 5 in which the control means are arranged to effect ON and OFF operation of the light-emitting diodes of the illuminating means.

7. A sorting machine as claimed in claim 5 in which the control means are arranged to effect amplitude modulation of the light produced by the light-emitting diodes of the illuminating means.

8. A sorting machine as claimed in claim 5 in which the control means is arranged to adjust the relative intensity of the differently coloured light.

9. A sorting machine as claimed in claim 5 in which the control means effect differential modulation of the light produced by differently coloured first and second light-emitting diodes of the illuminating means.

10. A sorting machine as claimed in claim 4 in which differently coloured first and second light-emitting diodes are used to effect both front lighting of the objects and lighting of the background means.

11. A sorting machine as claimed in claim 1 comprising means for varying the relative intensity of the light produced by the first and second lighting means.

12. A sorting machine as claimed in claim 1 in which each background means comprises a housing having a diffusing screen behind which are disposed the said first and second lighting means.

13. A sorting machine for sorting objects by examining light from the objects in at least two different parts of the spectrum, said sorting machine comprising:

feeding means for feeding objects to be sorted to a viewing zone;

illuminating means for effecting illumination in at least two different parts of the spectrum of objects passing through the viewing zone, said illuminating means comprising a plurality of differently colored light-emitting diodes which are respectively arranged to direct differently colored light onto objects passing through the viewing zone;

control means arranged to control the light produced by each light-emitting diode of the illuminating means and to effect ON and OFF operation of the latter;

viewing means arranged to view objects passing through the viewing zone;

at least one background means against which the objects are viewed by the viewing means;

at least first and second lighting means for each background means, said first and second lighting means being separate from said illuminating means and being respectively arranged to cause the respective background means to emit light in said at least two different parts of the spectrum; disriminator means, controlled by the output from the viewing means, for determining whether objects which have been so viewed are desired; and object separation means, controlled by said discriminator means, for effecting relative separation between desired and undesired objects, said lighting means comprising differently colored first and second light-emitting diodes, the lighting means being arranged to be operative throughout said ON and OFF operation, whereby during the said OFF operation, each output from the discriminator means is representative of the degree to which the light from each background means is obscured by an object in a viewing zone and is thus representative of the size of the object.

14. A sorting maching for sorting objects by examining light from the objects in at least two different parts of the spectrum, said sorting machine comprising:

feeding means for feeding objects to be sorted to a viewing zone;

illuminating means for effecting illumination in at least two different parts of the spectrum of objects passing through the viewing zone, said illuminating means comprising a plurality of differently colored light-emitting diodes which are respectively arranged to direct differently coloured light onto objects passing through the viewing zone;

viewing means arranged to view objects passing through the viewing zone;

at least one background means against which the objects are viewed by the viewing means;

at least first and second lighting means for each background means, said first and second lighting means being separate from said illuminating means and being respectively arranged to cause the respective background means to emit light in said at least two different parts of the spectrum;

discriminator means, for determining whether objects which have been so viewed are desired; and object separation means, controlled by said discriminator means, for effecting relative separation between desired and undesired objects, said illuminating means comprising differently colored first and second light-emitting diodes which are amplitude modulated at a different frequency, said viewing means comprising first and second bandpass filters whose outputs are respectively representative of the light from the objects produced respectively by the first and second light-emitting diodes of the illuminating means.

15. A method of sorting objects whose color comprises components having a predetermined relative intensity in two different parts of the spectrum, said method comprising:

feeding objects to be sorted to a viewing zone;

employing illuminating means to effect illumination in said two different parts of the spectrum of objects passing through the viewing zone;

viewing objects passing through the viewing zone against at least one background means;

selecting first and second lighting means, substantially the whole of the light from which is respectively in said two different parts of the spectrum;

employing said first and second lighting means to effect lighting of each background means, said first and second lighting means being separate from said illuminating means and being respectively adjusted to cause the respective background means to emit light in said two different parts of the spectrum with said relative intensity; employing discriminator means, controlled by the output from the viewing means, for determining whether objects which have been so viewed are desired; and employing object separation means, controlled by said discriminator means, for effecting relative separation between desired and undesired objects.

16. A sorting machine for sorting objects by examining light from the objects in at least two different parts of the spectrum, said sorting machine comprising:

feeding means for feeding objects to be stored to a viewing zone;

illuminating means for effecting illumination in at least two different parts of the spectrum of objects passing through the viewing zone;

viewing means arranged to view objects passing through the viewing zone;

at least one background means against which the objects are viewed by the viewing means;

at least first and second lighting means and a diffusing screen for each background means, said first and second lighting means being separate from said illuminating means and being respectively arranged to cause the respective diffusing screen to emit light in said at least two different parts of the spectrum;

discriminator means, controlled by the output from the viewing means, for determining whether objects which have been so viewed are desired;

object separation means, controlled by said discriminator means, for effecting relative separation between desired and undesired objects, and control means for effecting ON and OFF operation of the illuminating means, the lighting means for lighting each background means being arranged to be operative throughout said ON and OFF operation, whereby during said OFF operation, each output from the discriminator means is representative of the degree to which the light from each background means is obscured by an object in the viewing zone and is thus representative of the size of the object.

17. A sorting machine for sorting objects by examining light from the objects in at least two different parts of the spectrum, said sorting machine comprising:

feeding means for feeding objects to be sorted to a viewing zone;

first and second illuminating means for effecting illumination in at least two different parts of the spectrum of objects passing through the viewing zone;

viewing means arranged to view objects passing through the viewing zone;

at least one background means against which the objects are viewed by the viewing means;

at least first and second lighting means and a diffusing screen for each background means, said first and second lighting means being separate from said first and second illuminating means and being respectively arranged to cause the respective diffusing screen to emit light in said at least two different parts of the spectrum;

discriminator means, controlled by the output from the viewing means, for determining whether objects which have been so viewed are desired; and object separation means, controlled by said discriminator means, for effecting relative separation between desired and undesired objects, the first and second illuminating means being respectively arranged to direct differently colored light onto objects passing through the viewing zone and being respectively amplitude modulated at a different frequency, the viewing means comprising first and second bandpass filters whose outputs are respectively representative of the light from the objects produced respectively by the first and second illuminating means.

* * * * *